US007004150B2

(12) United States Patent
Augustin

(10) Patent No.: US 7,004,150 B2
(45) Date of Patent: Feb. 28, 2006

(54) CONTROL VALVE FOR FUEL INJECTOR AND METHOD OF USE

(75) Inventor: Ulrich Augustin, Blythewood, SC (US)

(73) Assignee: Siemens Diesel Systems Technology VDO, Blythewood, SC (US)

( * ) Notice: Subject to any disclaimer, the term of this patent is extended or adjusted under 35 U.S.C. 154(b) by 0 days.

(21) Appl. No.: 10/814,274

(22) Filed: Apr. 1, 2004

(65) Prior Publication Data

US 2005/0034708 A1 Feb. 17, 2005

Related U.S. Application Data

(63) Continuation-in-part of application No. 10/638,322, filed on Aug. 12, 2003.

(51) Int. Cl.
*F02M 37/04* (2006.01)

(52) U.S. Cl. ..... 123/494; 123/500

(58) Field of Classification Search ..... 123/494, 123/500, 501, 446, 456, 458, 498; 73/119 A; 239/89–95

See application file for complete search history.

(56) References Cited

U.S. PATENT DOCUMENTS

| | | | | |
|---|---|---|---|---|
| 4,494,696 | A * | 1/1985 | Schneider | 239/90 |
| 5,042,445 | A * | 8/1991 | Peters et al. | 123/446 |
| 5,477,834 | A * | 12/1995 | Yoshizu | 123/501 |
| 5,740,782 | A * | 4/1998 | Lowi, Jr. | 123/446 |
| 6,253,736 | B1 * | 7/2001 | Crofts et al. | 123/498 |
| 6,575,126 | B1 * | 6/2003 | Sturman | 123/90.11 |
| 2003/0106533 | A1 * | 6/2003 | Crofts et al. | 123/446 |

* cited by examiner

*Primary Examiner*—Carl S. Miller

(74) *Attorney, Agent, or Firm*—McGuireWoods LLP

(57) ABSTRACT

A control a control for an injector includes an energizing device actuated by a fluid pressure during an injection event to provide a monitoring voltage. The control unit is used with an injector and is capable of monitoring the variables of the injector such as opening and closing times of the spool valve by using a pressure of the working fluid. The control unit can control the opening and closing of the injector by determining the opening times based on a generated voltage.

17 Claims, 5 Drawing Sheets

CONTROL VALVE FOR FUEL INJECTOR AND METHOD OF USE

CROSS REFERENCE TO RELATED APPLICATIONS

This application is a continuation-in-part application of co-pending U.S. patent application Ser. No. 10/638,322, filed Aug. 12, 2003, which is hereby incorporated by reference for all purposes as if fully set forth herein.

BACKGROUND OF THE INVENTION

1. Field of the Invention

The invention generally relates to a control valve for a fuel injector and, more particularly, to a piezoelectric control valve for a hydraulically actuated fuel injector.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

In current designs, a driver will deliver a current or voltage to an open side of an open coil solenoid. The magnetic force generated in the open coil solenoid will shift a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure chamber. As the pressure in the high pressure chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

However, in such a conventional system, a response time between the injection cycles may be slow thus decreasing the efficiency of the fuel injector. Also, injection events may vary in duration. This is mainly due to the slow movement of the control valve spool. More specifically, the slow movement of the control valve spool may result in a slow activation response time to begin the injection cycle. To remedy this inadequacy, additional pressurized working fluid may be needed; however, additional energy from a high pressure oil pump must be expanded in order to provide this additional working fluid. This leads to inefficiency in the operations of the fuel injector, itself. Also, the working fluid at an end of an injection cycle may not be vented at an adequate response rate due to the slow movement of the control valve spool.

A solution to the foregoing problems is the utilization of a piezoelectric actuator system as disclosed in co-pending U.S. patent application Ser. No. 10/638,322. In this system many advantages over the related art systems are provided such as, for example, providing a short control valve stroke. This shorter stroke translates into a fast response time for outflow of the inlet rail pressure, thereby the fuel injector has an increased efficiency over the related art. Further control features can be provided to fuel injectors in order to provide even greater advantages and efficiencies over known related art systems.

SUMMARY OF THE INVENTION

In a first aspect of the invention, a control valve for an injector, comprises an energizing device actuated by a fluid pressure during an injection event to provide a monitoring voltage.

In another aspect of the invention, the control valve for an injector, comprises a control valve body having a bore and a plurality of fluid connections and a spool valve assembly moveable within the bore between a first position and a second position. The spool valve assembly has a first hydraulic surface and a second opposing hydraulic surface in fluid communication with a first fluid connection and a second fluid connection, respectively, of the plurality of fluid connections. An actuator as a fluid connection between ambient and the second hydraulic surface of the spool valve assembly. The actuator is sensitive to a spool valve opening via at least one of fluid pressure or mechanical pressure.

In a third aspect of the invention, a fuel injector is provided with a control valve. The fuel injector includes an intensification body, a nozzle assembly and a control valve assembly.

DETAILED DESCRIPTION OF EMBODIMENTS OF THE INVENTION

The invention is directed to an oil activated electronically, mechanically or hydraulically controlled fuel injector and more particularly to a control valve used with an oil activated fuel injector. The control valve of the invention, in one aspect, is capable of providing increased efficiency, as well as adjusting variations between injectors within a system, or shot-to-shot variations within a single fuel injector. A controller may be utilized to optimize the performance of an injector or system of injectors.

For example, in one aspect of the invention, an energizing device may be actuated by a fluid pressure during injection events in order to monitor a voltage. A controller may utilize this monitoring voltage and make required changes to increase the performance of an injector. In one aspect of the invention, the monitoring system may include a feedback control, communicating with a piezo electric disk plate, either part of or separated from a control of the injector. For example, a sensor may be provided near one of the working ports to determine the start of an injection event. The invention may also be used as a kit to retrofit already existing fuel injectors.

Control Valve of the Invention

Figure 1:
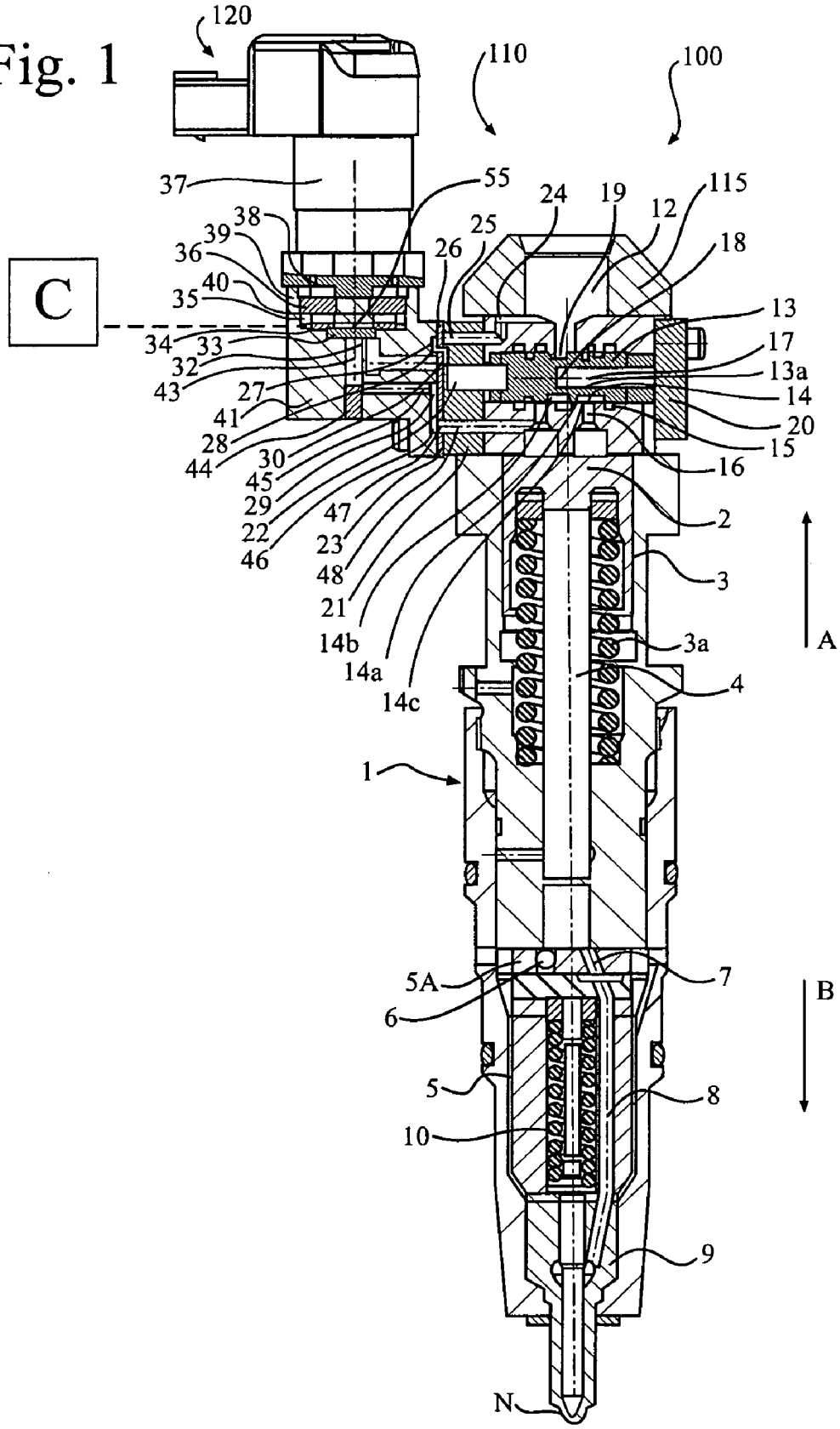
FIG. 1 shows an oil activated fuel injector used with a piezoelectric control valve of the invention.

Referring now to FIG. 1, the fuel injector of the invention is generally depicted as reference numeral 100. The fuel injector 100 includes a control valve 110 and an intensifier body 1 having a piston 2 and plunger 4 disposed within a bore chamber 3. A spring 3*a* biases the piston 2 and the plunger 4 in a direction of arrow "A". The injector 100 also includes a needle or nozzle assembly 5. A high pressure fuel chamber 7 is disposed between the plunger 4 and the nozzle assembly 5, and is in fluid communication with a fuel line 8 leading to a needle assembly 9. A check valve 6 is also provided within the nozzle assembly 5 or alternatively in a disk plate 5*a* between the nozzle assembly 5 and the intensifier body 1. A spring 10 biases the needle assembly 9 in a direction of arrow "B".

Still referring to FIG. 1, a valve body is generally depicted as reference numeral 115 and includes an oil or working fluid inlet 12 and a spool 13. The spool 13 includes grooves having control edges depicted generally as reference numeral 14, i.e., a first leading edge 14*a* and a second leading edge 14*b*. The valve body 115 also includes grooves, depicted generally as reference numeral 15, which lead to ambient. Working ports 16 are provided in the valve body 115, which lead to the bore chamber 3 and more specifically are in communication with the piston 2. The working ports 16 are also in fluid communication with the working fluid inlet 12 via the grooves of the spool 13 though a space 14*c* formed between the leading edge 14*a* and the working port 16 when the spool 13 is in the open position.

A control piston 17 is provided in a center bore 13*a* of the spool 13. A control volume chamber 18 is formed between the control piston 17 and the spool 13. A cross bore 19 provides fluid communication between the working fluid inlet 12 and the control volume chamber 18. A stop plate 20 is positioned proximate an end portion of the control piston 17, remote from the spool 13. The stop plate 20 provides a mechanism for limiting movement of the control piston 17 during cycles of the fuel injector 100.

A second control piston 22 is provided on another side of the spool, remote from the control piston 17. In one embodiment, the second control piston 22 has a larger surface area than the control piston 17. In one implementation, the second control piston 22 may be upwards of two times the diameter of the control piston 17. The ratio of size may be 1:1.2 upwards of 1:2 in one range, the smaller control piston 17 may be 2.5 mm, but may be 3 mm with the second control piston 22 being 4 mm, in one illustrative implementation. The second control piston 22 is positioned proximate a plate 23 which includes an inlet throttle 26 and an outlet throttle 30, as well as an additional bore 47 (discussed in more detail below).

A fluid connection 24 is provided between the working fluid inlet 12 and the inlet throttle 26, via a fluid connection 25 provided in housing 21. A fluid connection 27 is provided in a piezo stand or housing 41 between the inlet throttle 26 and a bore 28 provided in either the plate 23 or the housing 21. The bore 28 connects to a control volume chamber 29 of the second control piston 22. In one embodiment, the control volume chamber 29 is formed by the second control piston 22, the plate 23 and the housing 21. The outlet throttle 30 is provided in the plate 23 and provides fluid communication between the control volume chamber 29 and a fluid connection 32 to a check plate 33 in an actuator assembly generally depicted as reference numeral 120. The check plate 33 is seated on a check plate seat 34.

As to the actuator assembly 120, a fluid connection 35 is positioned above the check plate 33 and is connected to ambient. A disk 36 having a substantially centrally located bore 36*a* is positioned between the check plate 33 and a piezo actuator 37. The piezo actuator 37 includes a center pin 38 and an outer part 39. A push rod 40 is in mechanical communication with the center pin 38 and is movable via the piezo actuator 37.

Still referring to FIG. 1, a control system is shown generally as reference number 55. The control system 55 includes a feedback piston 43 in communication with the check plate 33. A plug 44 is positioned between the feedback piston 43 and the communication channel 45. The feedback piston 43 is in fluid communication with at least one of the working ports 16 via flow connections 45, 46, 47, and 48. The plug 44 is formed in a bore within the housing 41 and is in fluid communication with the fluid connection 45. The fluid connection 45 may be a bore within the housing 21. The fluid connection 45 is in fluid communication with the fluid connections 46 and 47. The fluid connection 47 is a bore provided in plate 23 and is in communication between fluid connections 48 and 46. In one embodiment, fluid connection 46 is formed between a surface of the plate 23 and a milled portion of the housing 41. The fluid connection 48 may be a bore in the housing 21 and spool body, communicating directly with the working port 16. In this manner, the feedback piston 43 may be in fluid communication with the working port 16. It should be recognized, though, that the feedback piston may be separated from the housing, using the same inventive concept in fluid communication with the working fluid below the spool.

The actuator assembly includes a housing-like a pot, where the piezo stack is located in the center of the pot. The piezo has substantially the same height as the pot and one end of the piezo is welded on the bottom of the pot. In a final manufacturing process the open side of the pot/piezo assembly is grounded. Once the piezo is activated, the stack expands and comes out of the pot. In the application of the invention, the center pin makes a relative stroke to the outer part 39 (border of the pot). Typical strokes of this size of piezo are 20 to 50 microns.

In one embodiment, the piezo actuator includes approximately 200 layers of ceramic discs, which respond to a current applied to the piezo actuator 37. It should be well understood, though, that more or less layers and other types of discs are contemplated by the invention and that the example provided herein is for illustrative purposes.

FIG. 1, further shows a controller C utilized in combination with the control system 55. The controller C may be used to control the injection events (e.g., fuel injection rate or duration of injection event). In one aspect, the controller may determine when an injection event has started or other variables associated with injection event, via the movement and hence generated voltage from the check plate 33. The controller may utilize any type of control loop configuration.

For example, the controller may utilize a feedback control loop to allow for dynamic control between or during injection events of an injector or system of injectors.

In one aspect of the invention, the feedback piston 43 may apply mechanical pressure onto the check plate 33 at a start of a fuel injection event. That is, the fluid from the working ports 16 provides fluid pressure to a distal end of the feedback piston 43. This, in turn, will provide movement to the feedback piston 43, so that the proximate end of the feedback piston 43 will contact or provide a pressure force against the check plate 33. During this state, the check plate 33 is open to actuate movement of the spool into the open position.

As the feedback piston 43 asserts pressure against the check plate 33 an electric signal is generated via the piezoelectric disk in proportion to the applied mechanical force. The controller can then utilize the electrical signal to monitor fluctuations between the actual starting of the injection event and the end of the injection event or any other injection event variations. For example, the controller may be used to determine an exact opening time of the spool valve. Accordingly, the system may be calibrated to obtain optimized performance of the injector throughout the lifetime of the injector by utilizing aspects of the invention.

Figure 2:
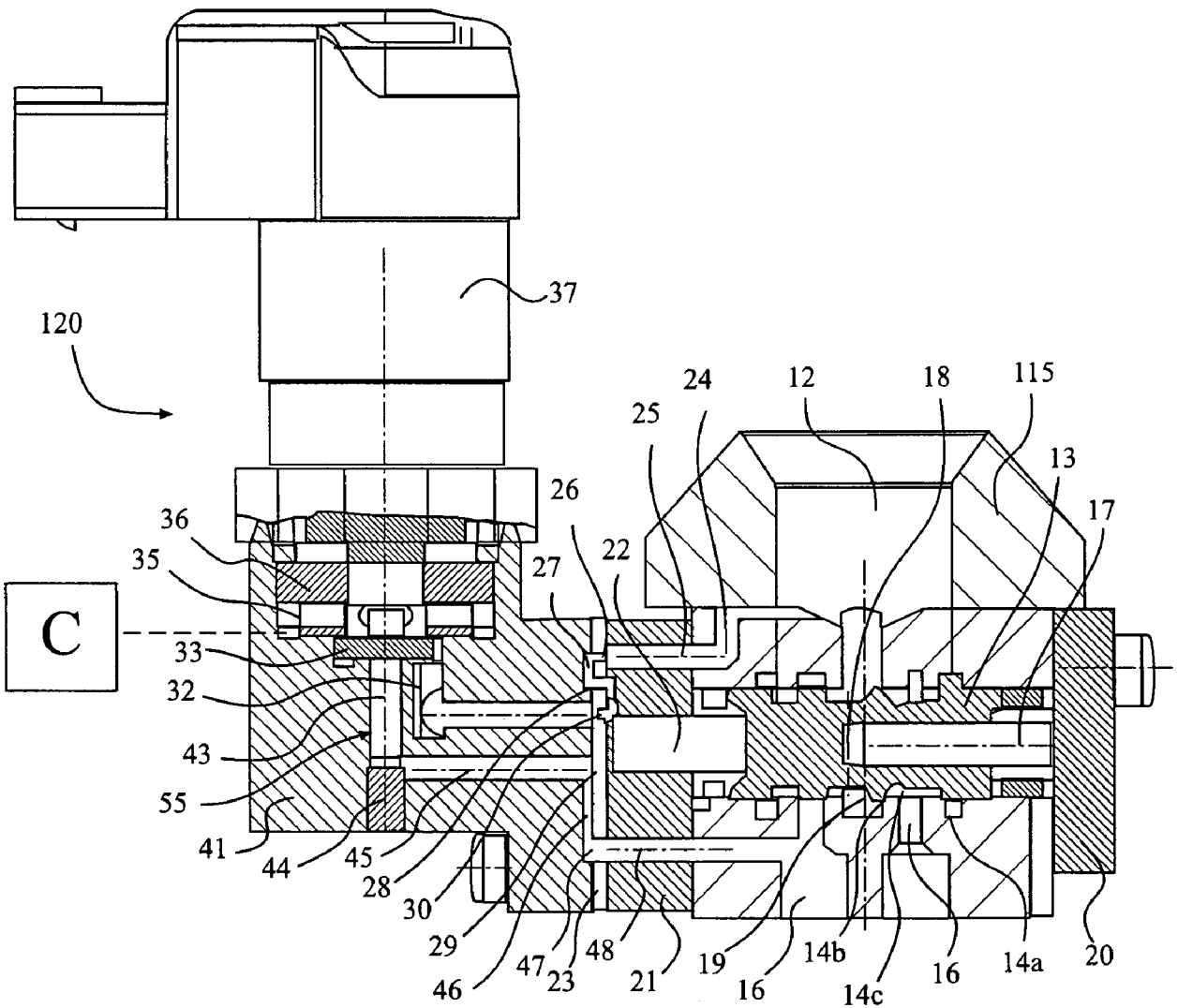
FIG. 2 shows an exploded view of a control valve body of the invention.

FIG. 2 shows an enlarged view of the assembly of the invention. The assembly basically includes the valve body 115 in addition to the piezo actuator valve assembly 120. The valve body 115 is shown to include the working fluid inlet 12 and the spool 13. The spool 13 includes grooves having a first leading edge 14*a* and a second leading edge 14*b* in communication with the working port 16. The space 14*c* formed between the first leading edge 14*a* and the working port 16 allows working fluid communication between the working fluid inlet 12 and the working port 16 when the spool 13 is in the open position. In this view, the control piston 17 is biased against the stop plate 20 due to a bigger control volume pressure in the control volume chamber 18 than that provided in the control volume chamber 29. This occurs when the piezo actuator is activated, i.e., a current is applied to the piezo actuator which opens the control volume chamber 29 to ambient. The cross bore 19 provides fluid communication to the control volume chamber 18.

Still referring to FIG. 2, the spool valve assembly 115 includes the second control piston 22 partly moveable within the bore of the housing 21 and proximate to the plate 23. The fluid connection 24, partly in the valve body 115, is provided between the working fluid inlet 12 and the inlet throttle 26, via the fluid connection 25 provided in the housing 21. The bore 28 connects between the control volume chamber 29 and the fluid connection 25 by way of the fluid connection 27 provided in the piezo stand 41. The outlet throttle 30, in the plate 23, provides fluid communication between the control volume chamber 29 and the fluid connection 32 and check plate 33 to ambient via the fluid connection 35. The disk 36 is positioned between the check plate 33 and the piezo actuator 37. In this aspect, the feed back piston 43 is in fluid communication with the working ports 16 via flow connections 45, 46, 47, and 48.

In this configuration, working fluid may pressurize the control volume chamber 29 via the fluid connection 24, the inlet throttle 26, the fluid connections 25 and 27 and the bore 28. In this manner, when the piezo actuator is closed, the pressure will increase in the control volume chamber 29 thus increasing the hydraulic forces acting on the second control piston 22. The hydraulic forces acting on the second control piston 22 will then exceed the hydraulic forces acting on the control piston 17 (due to the larger surface area of the second control piston 22) thus moving the spool valve assembly into the closed position, i.e., the leading edge 14*b* will overlap the working port 16 and block the space 14*c*.

To open the spool valve assembly, the piezo actuator is opened or activated by applying a current to the driver of the piezo actuator. The fluid pressure within the control volume chamber 29 will be lowered, i.e., the pressure will be released to ambient, by way of the outlet throttle 30, the fluid connection 32, the check plate 33 and the fluid connection 35. In this manner, the pressure in the control volume chamber 29 will be lower than the inlet fluid pressure caused by a steady inflow via the cross bore 19 and working fluid inlet 12. The hydraulic forces acting on the control piston 17 will then exceed the hydraulic forces acting on the second control piston 22 (due to the higher pressure in the control volume chamber 18 than the control volume chamber 29) thus moving the spool valve assembly into the open position, i.e., aligning the space 14*c* with the working port 16. At this stage, pressurized fluid will follow through fluid connections 45, 46, 47, and 48, in order to energize the check plate 33 via movement of the feedback piston 43.

Figure 3:
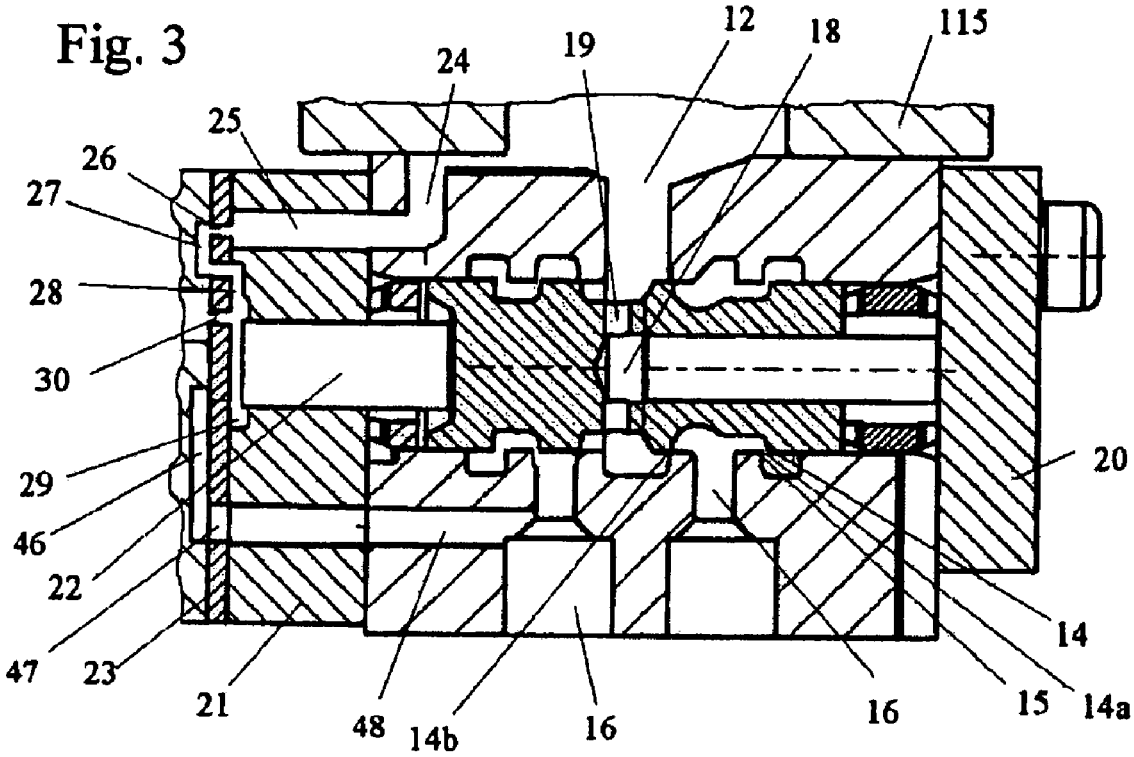
FIG. 3 shows an exploded view of a spool valve assembly of the invention.

FIG. 3 shows an exploded view of the spool valve assembly in the closed position. The cross bore 19 is provided in the spool 13 and allows fluid communication to remain open between the working fluid inlet 12 and the control volume chamber 18. In this manner, working fluid is constantly provided to the control volume chamber 18. The leading edges 14*a* and 14*b* are shown to be in fluid communication or overlapping with the working port 16. In the closed position, the leading edge 14*b* seals or blocks the fluid communication between the working port 16 and the working fluid inlet 12. The inlet and outlet throttles 26 and 30 are shown to be in communication with the control volume chamber 29. The second control piston 22 is in fluid or hydraulic communication with the working fluid inlet 12 via the fluid connections 24, 25, 27 and inlet throttle 26 and bore 28. As discussed, due to the increased hydraulic forces acting on the second control piston 22, the spool 13 is moved to the closed position and the leading edge 14*b* seals the space between the working fluid inlet 12 and the working port 16. In this aspect, the feed back piston 43 is in fluid communication with the working ports 16 via flow connections 45, 46, 47, and 48. In the closed position, the fluid pressure is not sufficient to provide movement of the feedback piston 43; however, the controller may still utilize such information to provide control to the system, as discussed herein.

Figure 4:
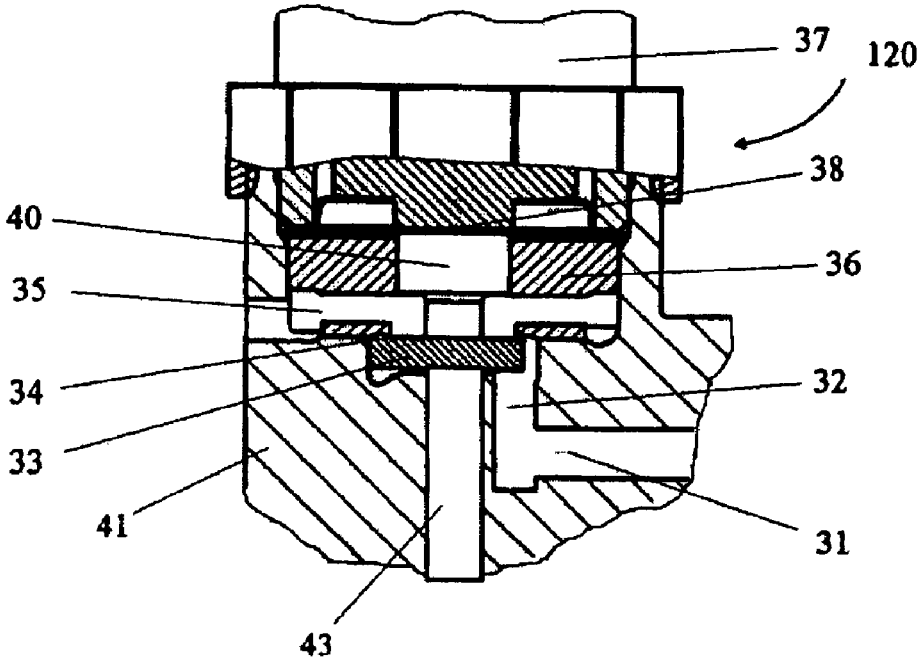
FIG. 4 shows an exploded view of an actuator assembly of the invention in a closed position.

FIG. 4 shows an exploded view of the control valve assembly 120 in the closed position. In the closed position, the check plate 33 will block fluid communication between the control volume chamber 29 and ambient. The hydraulic forces acting on the second control piston 28 will be greater than the hydraulic forces acting on the control piston 17 thus moving the spool 13 into the closed position. The stop plate 20 will limit the movement of the control piston 17 and hence the spool 13, in the closed position. The leading edge 14*b* will block communication between the working fluid inlet 12 and the working port 16. In this view, the feedback piston 43 is shown to be proximate the check plate 33.

Figure 5A:
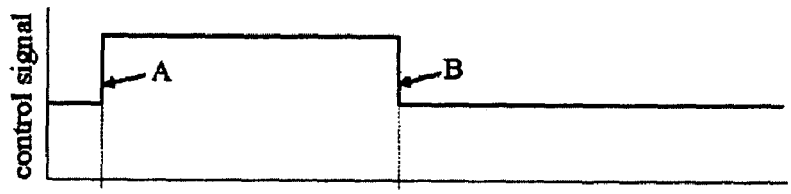
FIG. 5*a* shows a graph of an injector control signal versus time implemented by an aspect of the invention.
Figure 5B:
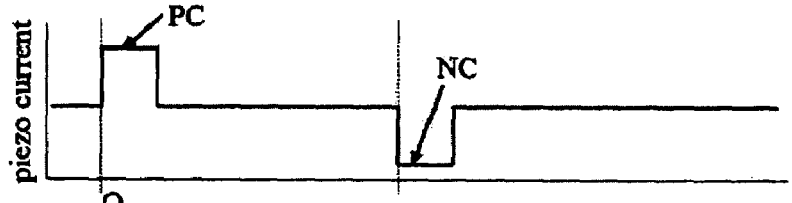
FIG. 5*b* shows a graph of piezo current versus time implemented by an aspect of the invention.

FIGS. 5*a*–5*e* show graphs of the injector control signal, the piezo current, the spool stroke and the injection rate versus time, respectively. More specifically, FIG. 5*a* shows a control signal that is provided to the driver of the piezo actuator 37. The first leading edge "A" of the control signal will trigger the positive driver current "PC" of the piezo actuator, as shown in FIG. 5*b*. At this time, the piezo actuator 37 will lengthen to open the spool valve assembly, as discussed above. The control signal will be responsible for the duration of the activation of the piezo actuator. In one embodiment, the control signal may last between 200 and 5000 microseconds, depending on the desired fuel quantity. It is also contemplated that the control signal may last for a longer or shorter time period, in certain applications.

Still referring to FIGS. 5*a* and 5*b*, the negative driver current "NC" shown in FIG. 5*b* is triggered by the falling edge "B" of the control signal of FIG. 5*a*. At this time, the spool valve assembly will begin to close; that is, the spool valve assembly will remain open until a reverse current is applied to the driver of the piezo actuator. In one embodiment, the pulses or currents may be approximately 100 microseconds in duration. As there is slight delay between the application of the positive driver current "PC" and the negative driver current "NC" and the opening and closing of the spool valve assembly. For example, the delay, in one embodiment, was about 100 microseconds or less. This delay may vary between injectors and/or over a specific injector's lifetime. However, the control system of the invention may automatically adjust injector events and other variables over the lifetime of the injector. Thus, the performance of the injector may be even further optimized.

In one embodiment, the positive driver current "PC" of the piezo actuator is +10 amps and the negative driver current "NC" is −10 amps. A corresponding voltage of 150V and 0V may be applied. It should be understood by those of ordinary skill in the art that different amperages may be used depending on the specific application of the invention. For example, additional layers utilized in the piezo actuator may translate into the need for a bigger current and a smaller voltage. Likewise, fewer layers used with the piezo actuator may translate into the need for a smaller current and a bigger voltage. However, in one implementation, a current of +/−10 amps is used with approximately 200 layers of the piezo actuator.

Figure 5C:
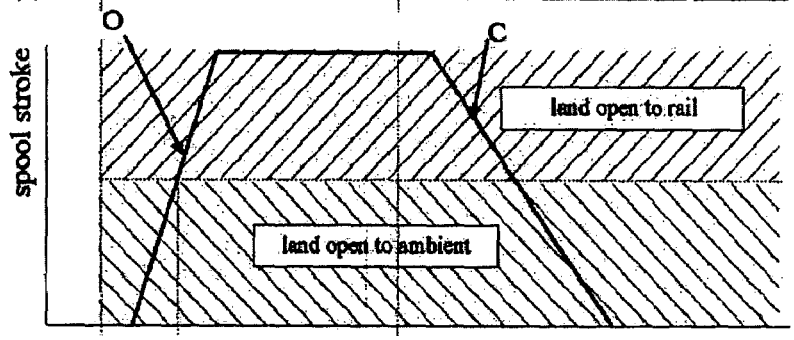
FIG. 5*c* shows a graph of a spool stroke versus time implemented by an aspect of the invention.
Figure 5D:
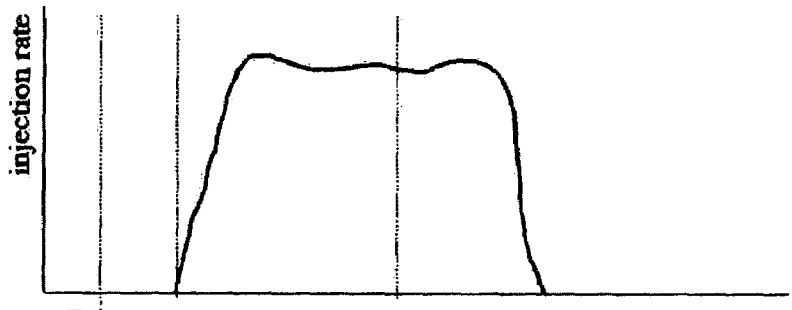
FIG. 5*d* shows a graph of injection rate versus time implemented by an aspect of the invention.

FIGS. 5*c* and 5*d* show the relationship between the spool stroke and the injection rate of the fuel injector. Referring to FIG. 5*c*, the bottom portion of the graph, i.e., land open to ambient, basically represents the spool valve assembly in the closed position; whereas, the upper portion of the graph, i.e., land open to rail, basically represents the spool valve assembly in the open position or a flow connection between the working fluid inlet 12 and the intensifier piston 2. It should be understood by those of ordinary skill in the art, though, that delay times $\Delta t$ may exist; that is, the spool valve assembly may remain open for a short period of time in the bottom portion of the graph after the negative driver current or pulse is applied as shown in FIG. 5*c* then results in a $\Delta t$ in FIG. 5*d*. Also, the spool valve assembly may remain closed for a short period of time in the top portion of the graph after the positive driver current or pulse is applied as shown in FIG. 5*c*. This open delay is also represented in FIG. 5*d* as $\Delta t_o$.

Referring back to FIG. 5*c* with reference to FIGS. 5*a* and 5*b*, after the positive driver current "PC" is applied, the spool valve assembly begins to open at a substantially constant speed as represented by the linear line "0". At the peak of the graph of FIG. 5*c*, the spool motion is stopped until the negative driver current "NC" is applied, at which time the spool valve assembly begins to close at a substantially constant speed.

Figure 5E:
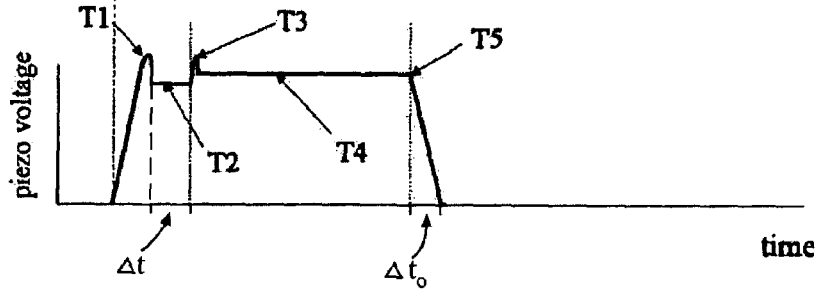
FIG. 5*e* shows a graph of piezo voltage versus time implemented by an aspect of the invention.

FIG. 5*e* shows the relationship between the piezo voltage versus time in accordance with principles of the invention. Referring to FIGS. 5*a*, 5*b* and 5*e* collectively, when control signal A is provided to the actuator 37, the voltage will begin to rise until it peaks at T1, at which time the check plate 33 will be open. A time delay $\Delta t_o$ occurs between the opening of the check plate 33 and the spool opening. This time delay is recorded as a constant voltage T2. When the spool opens, pressurized fluid will enter the working ports 16, at which time this fluid will travel through communication channels 45, 46, 47, and 48 and pressure will be provided to a distal end of the feedback piston 43. The proximate end of the feedback piston 43 will exert a pressure or contract force against the check plate. This will energize the check plate 33 resulting in a voltage spike recorded at T3.

After this initial voltage spike T3, the check plate will remain energized during fuel injection event, which is recorded at T4. It is noted, that the voltage at T4 may be greater than T2 because of a pressure or contact force being applied to the check plate 33 with the distal end of the feedback piston 43.

Next, a control signal B is applied and a negative driver current (NC) is applied to the system to enable the spool valve to close. This is recorded at T5. At this time, the voltage will decrease over time to 0V since no further current or pressure is being applied to the check valve. By monitoring the various voltages T1–T5, the controller can provide feedback to the controller in order to calibrate or control injection times, delays, or other injection variations. For example, the controller may vary the time at which control signals A and B are provided. In controlling the control signals A and B, the controller can adjust the time of the opening and closing of the spool, thereby adjusting injection events. This can be coordinated between several injectors to provide a coordinated control of an entire system, thus compensating for any delays that might occur. For example, delays between different piezo actuators of different injectors. Accordingly, the graph of FIG. 5*e* can equally represent a control function and feedback of the system.

Figure 6:
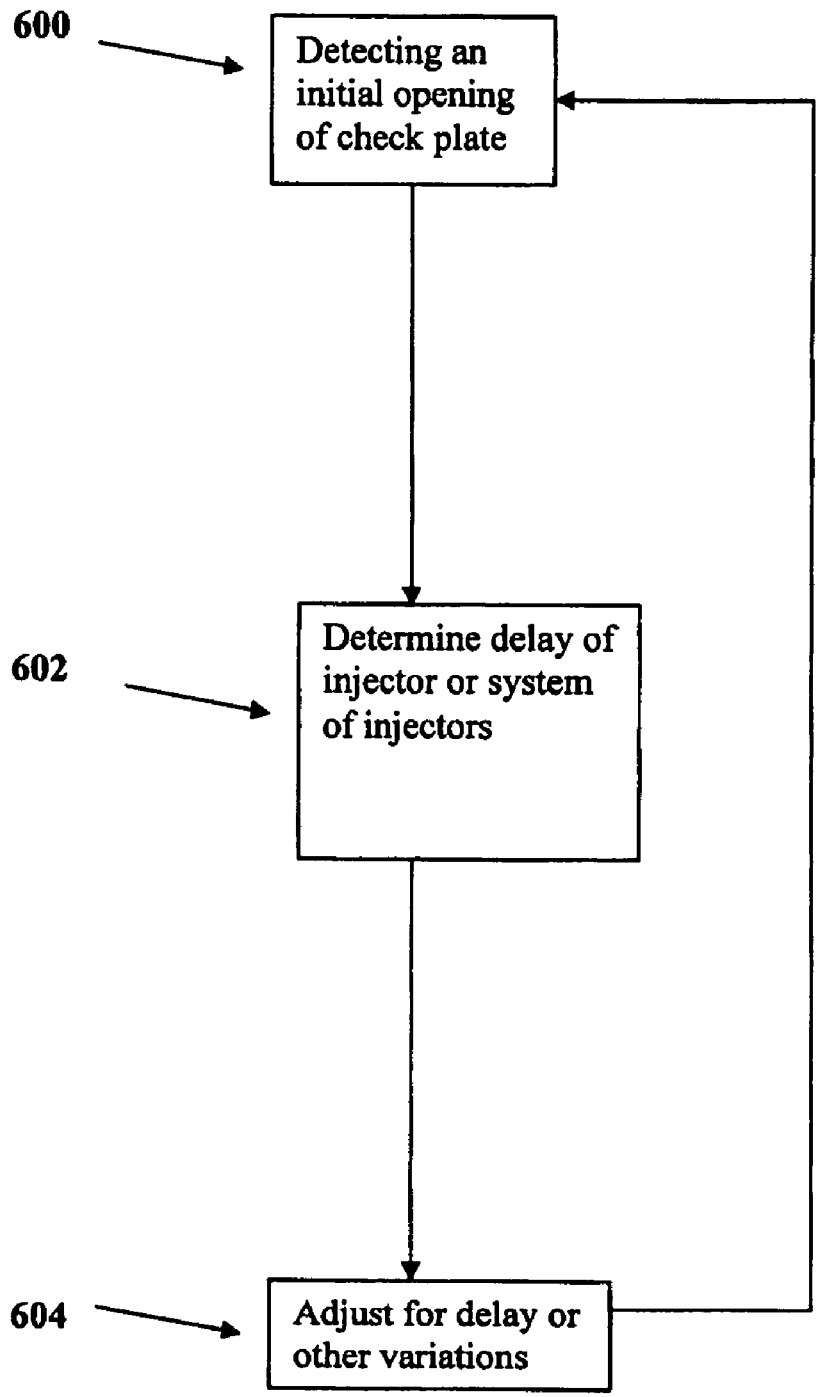
FIG. 6 shows a flow diagram implementing a control according to one aspect of the invention.

FIG. 6 shows one example of control according to the invention. In step, 600, the controller detects an initial opening of the check plate 33. In step 602, the controller determines a delay of any number of injectors. In step 604, the controller will adjust for any delay or other variations of the injectors. For example, the controller may adjust the time of the opening and closing events based on feedback form the control system. This will allow for increased performance of the injectors.

Method of Use

In operation, the check plate 33 and the spool valve assembly are movable between a closed position and an open position via application of the positive and negative driver current applied to the piezo actuator 37. That is, the current applied to the piezo actuator 37 is used to lengthen and shorten the piezo actuator 37, i.e., ceramic discs of the piezo actuator 37, to open and close the check plate 33 to ambient via the center pin and push rod assembly. In the open position, fluid in the control volume chamber 29 is vented to ambient and the pressure within the control volume chamber 18 is greater than that of the control volume chamber. The hydraulic forces acting on the control piston 17, being greater than the hydraulic forces acting on the second control piston 22, will then move the spool valve assembly to the open position. However, when the negative driver current is applied, the check plate 33 will block ambient and the hydraulic forces acting on the second control piston 22 will increase and become greater than the hydraulic forces acting on the control piston 17 such that the spool valve assembly will be moved into the closed position. Control feedback can be provided during these stages, as well.

Being more specific, when the piezo actuator 37 is activated or opened, the pressure within the control volume chamber 29 is decreased via the outlet throttle 30, fluid connection 32 and fluid connection 35 to ambient. In this case the hydraulic force acting on the control piston 17 is larger than the hydraulic force acting on the second control piston 22 such that the spool valve assembly is moved to the open position. Once in the open position, the leading edge 14*a* (creating space 14*c*) provides a fluid communication between the working fluid inlet 12 and the working port(s) 16. The working fluid then acts on the piston 2 which, in turn, acts on the plunger 4 against the spring force of the spring 3. As the plunger 4 moves towards the high pressure fuel chamber 7, the pressure within the high pressure fuel chamber 7 increases thus forcing the fuel towards the needle assembly 9. The fuel pressure will then overcome the spring force of the needle spring 10 and force the needle into the open position. The fuel will then be injected into a combustion chamber "C" of an engine via nozzles or injection ports "N" of the needle assembly.

At this time, the controller may detect a generated voltage from the check plate, via movement by the feedback piston 43. This may be provided by the working fluid acting on the feedback piston which, in turn, will act on the check plate.

When the piezo actuator 37 is closed (negative current applied), the pressure within the control volume or chamber 29 is increased via the fluid connection 24 provided between the working fluid inlet 12 and the inlet throttle 26, via the fluid connection 25. This occurs, partly, due to the check disk blocking ambient. Now, the hydraulic force acting on the second control piston 22 becomes larger than the hydraulic force acting on the control piston 17 such that the spool valve assembly is moved to the closed position. In this case, the leading edge 14*b* of the spool 13 will block fluid communication between the working port 16 and the working fluid inlet 12. The spring forces of the spring 3 and the spring 10 will overcome the hydraulic forces of the fuel and return the piston and plunger as well as the needle assembly, respectively, to the first or original position. The injection cycle will then end.

In operation, as shown in FIGS. 5*a* to 5*e*, a control signal A is provided to the actuator 37, at which time the voltage will begin to rise until it peaks at T1. At this time a check plate 33 will be open. A time delay $\Delta t_o$ occurs between the opening of the check plate 33 and the spool opening, where the time delay is recorded as a constant voltage T2. When the spool opens, pressurized fluid will enter the working ports 16, this fluid will travel through communication channels 45, 46, 47, and 48 and pressure will be provided to a distal end of the feedback piston 43. The proximate end of the feedback piston 43 will exert a pressure or contract force against the check plate 33. This will energize the check plate 33 resulting in a voltage which can be monitored by the control. When the negative control is provided, the voltage will decrease, as discussed above. As thus should now be understood, the signals T1–T5 may be utilized to increase an injector or a systems of injectors performance.

While the invention has been described in terms of embodiments, those skilled in the art will recognize that the invention can be practiced with modification within the spirit and scope of the appended claims.

What is claimed is:

1. A control for an injector, comprising a piezoelectric actuator energized by fluid pressure acting on a feedback piston during an injection event to provide a monitoring voltage, said feedback piston being moveable between a first position and a second position such that in the second position said feedback piston contacts a plate of said piezoelectric actuator to generate the monitoring voltage, and said feedback piston is moved from a first position to a second position with fluid provided from a working port.

2. The control for an injector of claim 1, wherein the monitoring voltage is associated with an applied opening current.

3. The control for an injector of claim 1, wherein the monitoring voltage is associated with a start of an injection event.

4. The control for an injector of claim 1, wherein the monitoring voltage is associated with a feedback control signal.

5. The control for an injector of claim 1, wherein the monitoring voltage is associated with a duration of an injection event.

6. The control for an injector of claim 1, wherein the monitoring voltage includes a plurality of voltages, comprising:

a first voltage associated with an applied opening current;

a second voltage associated with a start of an injection event;

a third voltage associated with a feedback control signal;

a fourth voltage a duration of an injection event; and a fifth voltage associated with an end of an injection event, wherein the first voltage is greater than the second voltage, the second voltage is greater than the third voltage, the third voltage is greater than the fourth voltage, and the fourth voltage is less than the second voltage.

7. The control for an injector of claim 1, wherein the fluid pressure is provided by an inlet rail during an injection event.

8. The control for an injector of claim 1, wherein the monitoring voltage is provided to a controlling means for controlling an opening and closing time of a spool of an injector via an actuating plate.

9. A control valve for an injector, comprising:

a control valve body having a bore and a plurality of fluid connections;

a spool valve assembly moveable within the bore between a first position and a second position, said spool valve assembly having a first hydraulic surface and a second opposing hydraulic surface in fluid communication with a first fluid connection and a second fluid connection, respectively, of the plurality of fluid connections; and an actuator having a fluid connection between ambient and the second hydraulic surface of said spool valve assembly, said actuator being sensitive to a spool valve opening via at least one of fluid pressure or mechanical pressure to provide a monitoring voltage.

10. The control valve of claim 9, wherein said actuator includes a check plate which is moveable between an open position and a closed position upon an application of current.

11. A control valve for an injector, comprising:

a control valve body having a bore and a plurality of fluid connections;

a spool valve assembly moveable within the bore between a first position and a second position, said spool valve assembly having a first hydraulic surface and a second opposing hydraulic surface in fluid communication with a first fluid connection and a second fluid connection, respectively, of the plurality of fluid connections; and an actuator having a fluid connection between ambient and the second hydraulic surface of said spool valve assembly, said actuator being sensitive to a spool valve opening via at least one of fluid pressure or mechanical pressure, said actuator including a check plate which is moveable between an open position and a closed position upon an application of current, the check plate generates a voltage upon the opening of the spool valve.

12. The control valve of claim 11, further comprising a feedback piston in communication with the check plate and working fluid for initiating the voltage.

13. The control valve of claim 12, wherein said feedback piston is movable from a first position upon opening of the spool valve assembly.

14. A control valve for an injector, comprising:

a control valve body having a bore and a plurality of fluid connections;

a spool valve assembly moveable within the bore between a first position and a second position, said spool valve assembly having a first hydraulic surface and a second opposing hydraulic surface in fluid communication with a first fluid connection and a second fluid connection, respectively, of the plurality of fluid connections;

an actuator having a fluid connection between ambient and the second hydraulic surface of said spool valve assembly, said actuator being sensitive to a spool valve opening via at least one of fluid pressure or mechanical pressure; and a controller to monitor an injection event via the actuator and to control the opening and closing of the spool valve of said spool valve assembly based on the voltage generated by a check plate of said actuator in response to the opening of the spool valve.

15. The control valve of claim 14, wherein said controller utilizes a feedback control loop to adjust an injection event.

16. The control valve of claim 15, wherein said controller senses the feedback piston contacting the check plate via a generated voltage.

17. A fuel injector, comprising:

an intensification body including a bore having a plunger and piston assembly biased in a first direction by a first spring and an intensifier chamber for pressurizing fuel;

a nozzle assembly in communication with said intensification body, said nozzle assembly including a needle valve system biased by a second spring to block injection ports and including a hydraulic surface to raise the needle valve away from the injection ports during an injection event; and a control valve assembly in communication with said intensification body, said control valve assembly including a control valve body having a bore and a plurality of fluid connections, a spool valve assembly moveable within the bore and having a first hydraulic surface and a second opposing hydraulic surface in fluid communication with a first fluid connection and a second fluid connection, respectively, an actuator in fluid connection between ambient and the second hydraulic surface of the spool valve assembly, and an energizing device actuated by a fluid pressure during an injection event to provide a monitoring voltage.

* * * * *